US007344276B2

(12) United States Patent
Chornenky

(10) Patent No.: US 7,344,276 B2
(45) Date of Patent: Mar. 18, 2008

(54) ILLUMINATION MATRIX WITH SUBSTANTIALLY SYMMETRICAL ARRANGEMENT

(76) Inventor: Todd Eric Chornenky, 125 Cambridge Rd., Bethel Park, PA (US) 15102

( * ) Notice: Subject to any disclaimer, the term of this patent is extended or adjusted under 35 U.S.C. 154(b) by 0 days.

(21) Appl. No.: 11/083,600

(22) Filed: Mar. 18, 2005

(65) Prior Publication Data

US 2005/0219842 A1 Oct. 6, 2005

Related U.S. Application Data

(60) Provisional application No. 60/554,281, filed on Mar. 18, 2004.

(51) Int. Cl.
*F21V 13/14* (2006.01)

(52) U.S. Cl. ..... 362/252; 362/800

(58) Field of Classification Search ..... 362/251, 362/252, 249, 652–654; 40/442, 452
See application file for complete search history.

(56) References Cited

U.S. PATENT DOCUMENTS

| | | | | |
|---|---|---|---|---|
| 1,034,478 | A | 8/1912 | McComb | |
| 2,210,718 | A | 8/1940 | Henninger, Jr. | |
| 3,501,217 | A | 3/1970 | Bottani | |
| 3,651,319 | A | 3/1972 | Norris et al. | |
| 3,694,645 | A | 9/1972 | Brantz | |
| 4,044,348 | A * | 8/1977 | Huebscher | 99/342 |
| 4,164,823 | A | 8/1979 | Marsico | |
| 4,809,584 | A | 3/1989 | Forrest | |
| 4,920,467 | A | 4/1990 | Honsberger | |
| 5,276,599 | A | 1/1994 | Neeley | |
| 5,424,925 | A * | 6/1995 | Jenke et al. | 362/123 |
| 6,307,527 | B1 * | 10/2001 | Youngquist et al. | 345/39 |
| 6,657,381 | B1 * | 12/2003 | Arutaki | 313/512 |
| 6,851,831 | B2 * | 2/2005 | Karlicek, Jr. | 362/249 |
| 6,923,548 | B2 * | 8/2005 | Lim | 362/612 |
| 6,969,185 | B1 * | 11/2005 | Adair | 362/542 |
| 7,174,664 | B2 * | 2/2007 | Spencer | 40/586 |
| 7,201,511 | B2 * | 4/2007 | Moriyama et al. | 362/646 |
| 7,214,118 | B1 * | 5/2007 | Maxim | 446/118 |
| 2002/0080609 | A1 * | 6/2002 | Ahroni | 362/252 |

FOREIGN PATENT DOCUMENTS

GB 2136673 A * 9/1984

* cited by examiner

*Primary Examiner*—Jong-Suk (James) Lee
*Assistant Examiner*—Leah S. Lovell
(74) *Attorney, Agent, or Firm*—James Ray & Assoc.

(57) ABSTRACT

An illumination matrix with a substantially symmetrical arrangement having a support member and a predetermined plurality of sets of illumination devices disposed one of on and in and a combination of on and in the support member. Each of the predetermined plurality of sets of illumination devices includes a predetermined number of illumination devices. The illumination devices in such sets being disposed in a substantially symmetrical matrix array having at least two substantially mirror axes, thereby producing an effect similar to reflected light without requiring use of mirrors. A control device is connected with the sets of illumination devices for separately controlling each of the sets of illumination devices. An energization supply is connected to the control means for energizing such sets of illumination devices in a predetermined manner.

24 Claims, 9 Drawing Sheets

ILLUMINATION MATRIX WITH SUBSTANTIALLY SYMMETRICAL ARRANGEMENT

CROSS-REFERENCE TO RELATED APPLICATION AND PATENT

This application is related to, and claims priority from, U.S. Provisional Patent Application Ser. No. 60/554,281, filed on Mar. 18, 2004. This application is also related to U.S. Pat. No. 6,692,138, issued Feb. 17, 2004. The teachings of U.S. Provisional Patent Application Ser. No. 60/554,281 and U.S. Pat. No. 6,692,138 are incorporated herein by reference thereto.

FIELD OF THE INVENTION

The present invention relates, in general, to an illumination matrix and, more particularly, this invention relates to an illumination matrix with a substantially symmetrical arrangement of illumination devices flashing in a predetermined manner.

BACKGROUND OF THE INVENTION

Prior to the conception and development of the present invention, kaleidoscopes were generally well known in the prior art. These prior art type kaleidoscopes usually employ two or more mirrors which are mounted in an angular relationship to provide a plurality of symmetrical images. A typical kaleidoscope consists of a tube like member having a pair of angled mirrors. A viewing port is disposed at one thereof, and a chamber containing a predetermined plurality of bits of colored glass is disposed at the other end thereof.

An electrical kaleidoscope is described in U.S. Pat. No. 1,034,478 entitled "Kaleidoscope". This kaleidoscope is a tube having angled mirrors. A view port is disposed at one end thereof, and a display of flashing lights is disposed at the other end thereof.

U.S. Pat. No. 6,692,138, entitled "Illumination Display Device Without Mirrors", describes an electrical kaleidoscope having lights that are energized simultaneously by a single circuit. Such lights are disposed in a substantially symmetrical array and have at least four mirror axes.

SUMMARY OF THE INVENTION

The present invention provides an illumination matrix with a substantially symmetrical arrangement of illumination devices flashing in a predetermined manner. The illumination matrix with a substantially symmetrical arrangement includes a support member. The support member has a predetermined plurality of sets of illumination devices disposed one of on and in and a combination of on and in the support member. Each set of the predetermined plurality of sets of illumination devices includes a predetermined number of illumination devices. The predetermined number of illumination devices in such sets being disposed in a substantially symmetrical matrix array having at least two substantially mirror axes, thereby producing an effect similar to reflected light without requiring the use of mirrors. An energization means is connected to the sets of illumination devices for energizing such sets of illumination devices in a predetermined manner. Further included is a control means connected to the energization means for controlling the sets of illumination devices to be energized.

OBJECTS OF THE INVENTION

It is, therefore, one of the objects of the present invention to provide an electronic illumination display device having a predetermined plurality of symmetrically placed lights which flash in at least one of a random and a pseudo random fashion.

Another object of the present invention is to provide a substantially continuously changing planar electronic illumination device capable of displaying a variety of information.

Still another object of the present invention is to provide an electronic illumination display device that has a relatively simple circuit.

Yet another object of the present invention is to provide an electronic illumination display device having lights that will flash in accordance with the beat of ambient music.

A further object of the present invention is to provide an electronic illumination display device having colored lights flashing in accordance with ambient music and in which the colors and intensity of the lights will depend on the pitch of the music, and the instrument playing the music.

An additional object of the present invention is to provide an electronic illumination display device that is relatively inexpensive to manufacture.

Still yet another object of the present invention is to provide an electronic illumination display device that is relatively maintenance free.

It is a further object of the present invention to provide an electronic illumination display device that is relatively simple to operate.

In addition to the various objects and advantages of the present invention which have been described in some detail above, it should be obvious that various additional objects and advantages of the invention will become more readily apparent to those persons who are skilled in the relevant art from the following more detailed description of the invention, particularly, when such description is taken in conjunction with the attached drawing figures and with the appended claims.

DETAILED DESCRIPTION OF THE PRESENTLY PREFERRED EMBODIMENTS OF THE INVENTION

Figure 1:
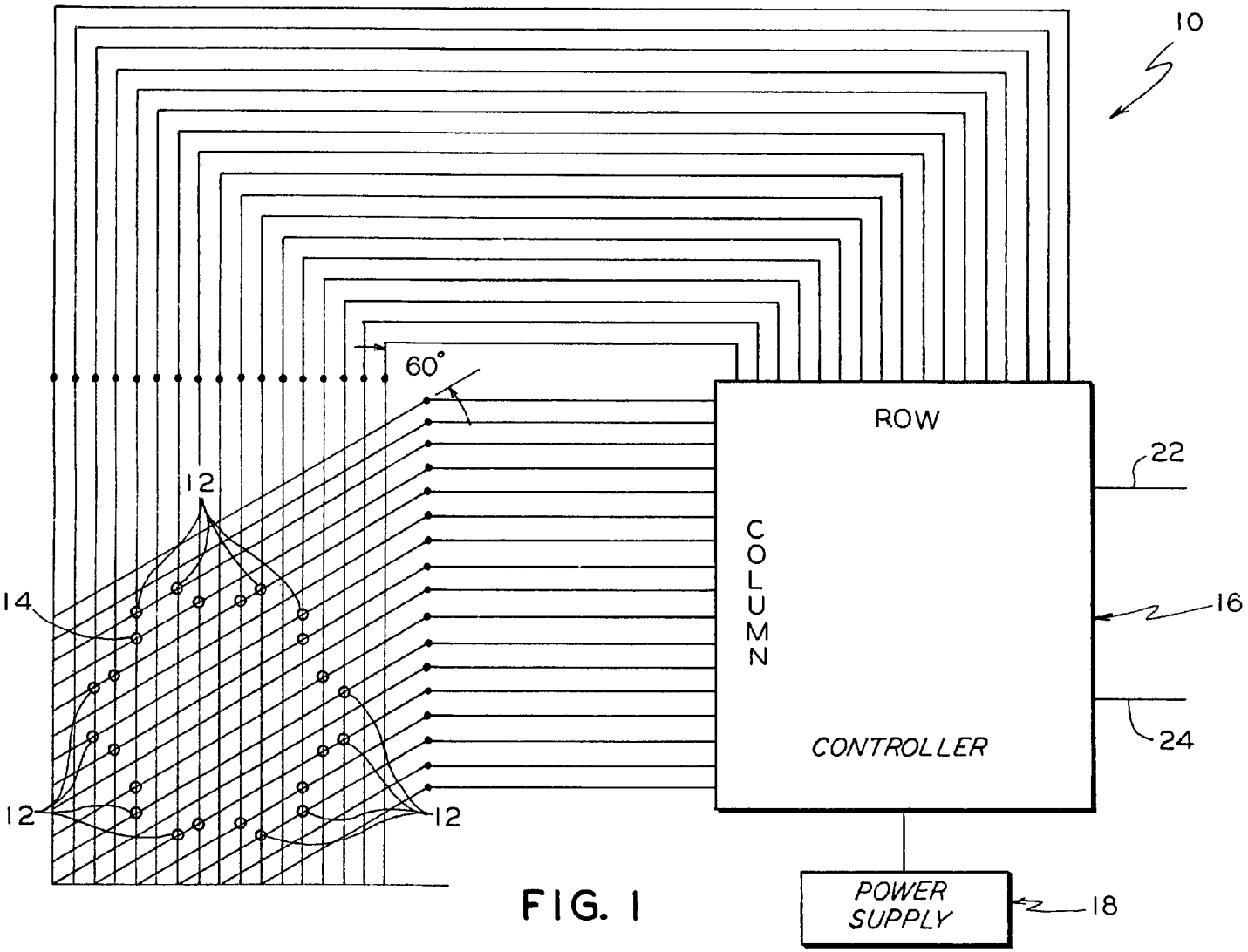
FIG. 1 is a schematic view of an illumination matrix with a substantially symmetrical arrangement showing a six-axis symmetry matrix.

Prior to proceeding to a much more detailed description of the present invention, it should be noted that identical components which have identical functions have been identified with identical reference numerals throughout the several views illustrated in the drawing figures for the sake of clarity and understanding of the invention.

Referring initially to FIG. 1 an illumination matrix with a substantially symmetrical arrangement constructed according to a presently preferred embodiment of the invention is generally indicated by reference numeral 10. The illumination matrix with a substantially symmetrical arrangement 10 includes a support member (not shown). The support member has a predetermined plurality of sets 12 of illumination devices 14 disposed one of on and in and a combination of on and in the support member.

Each of the predetermined plurality of sets 12 of illumination devices 14 includes a predetermined number of illumination devices 14. The illumination devices 14 have a predetermined address, and in a presently preferred embodiment such predetermined address is determined by a row and a column location. Each of the illumination devices 14 illuminate at various intensities according to a signal received from a control means 16. Also, each of the illumination devices 14 may be capable of displaying more than one color. The color to be displayed by a particular illumination device 14 at any one time is controlled by a signal received from the control means 16. Each of such illumination devices 14 is one of a lamp and a light emitting diode (LED).

Figure 2:
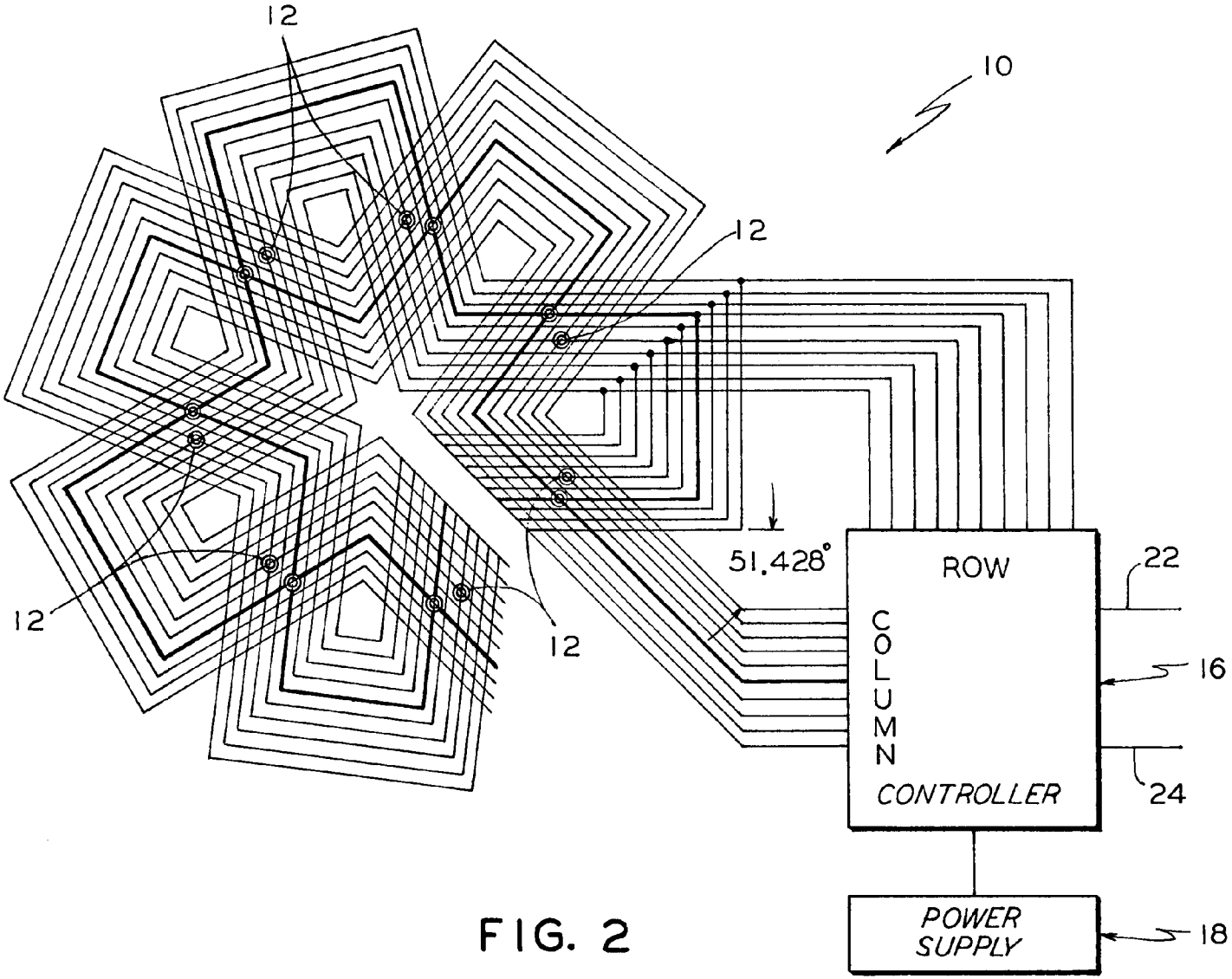
FIG. 2 is a schematic view of an illumination matrix with a substantially symmetrical arrangement showing a seven-axis symmetry matrix.
Figure 3:
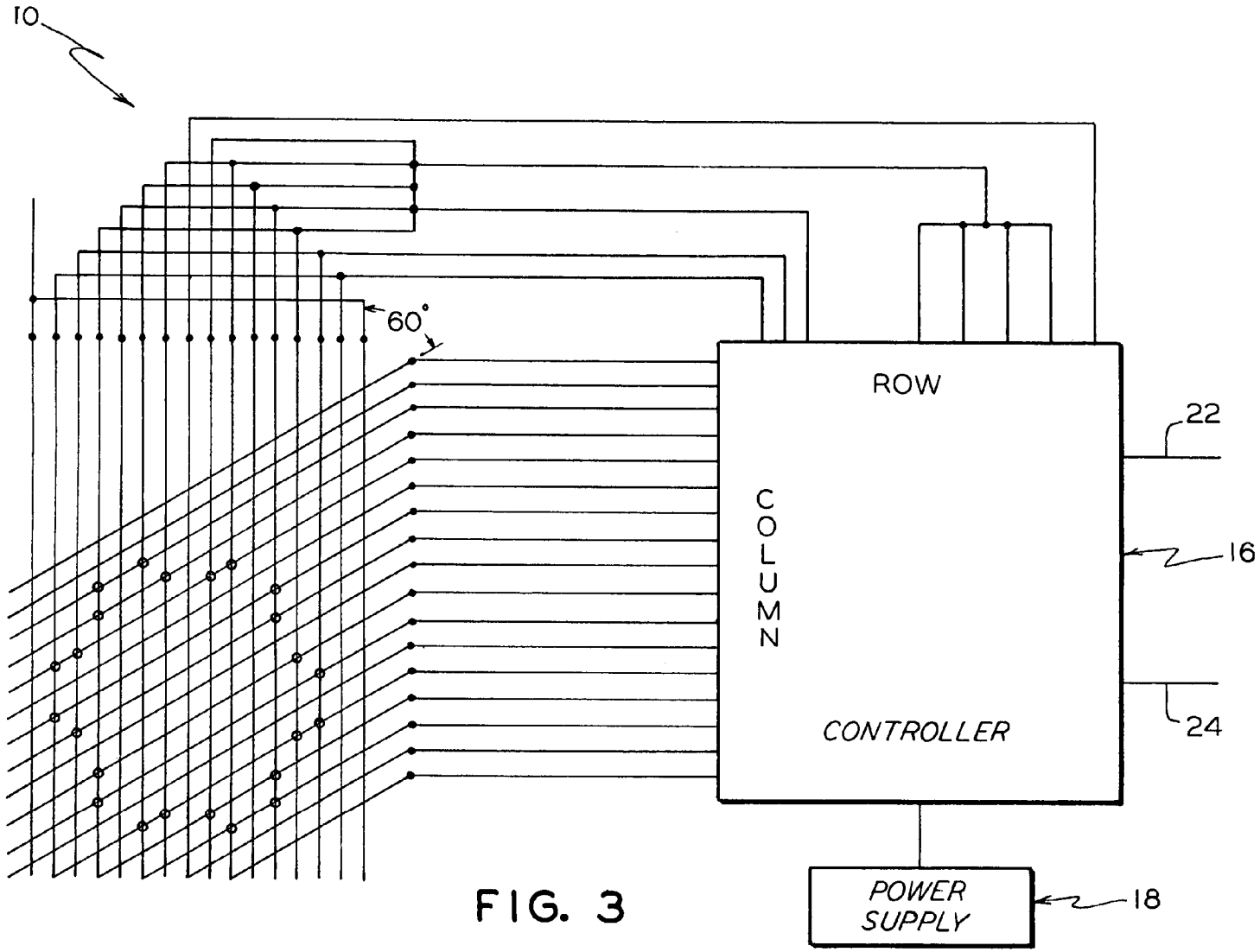
FIG. 3 is a schematic view of an illumination matrix with a substantially symmetrical arrangement showing a six-axis symmetry matrix having the number of columns reduced by half.
Figure 4:
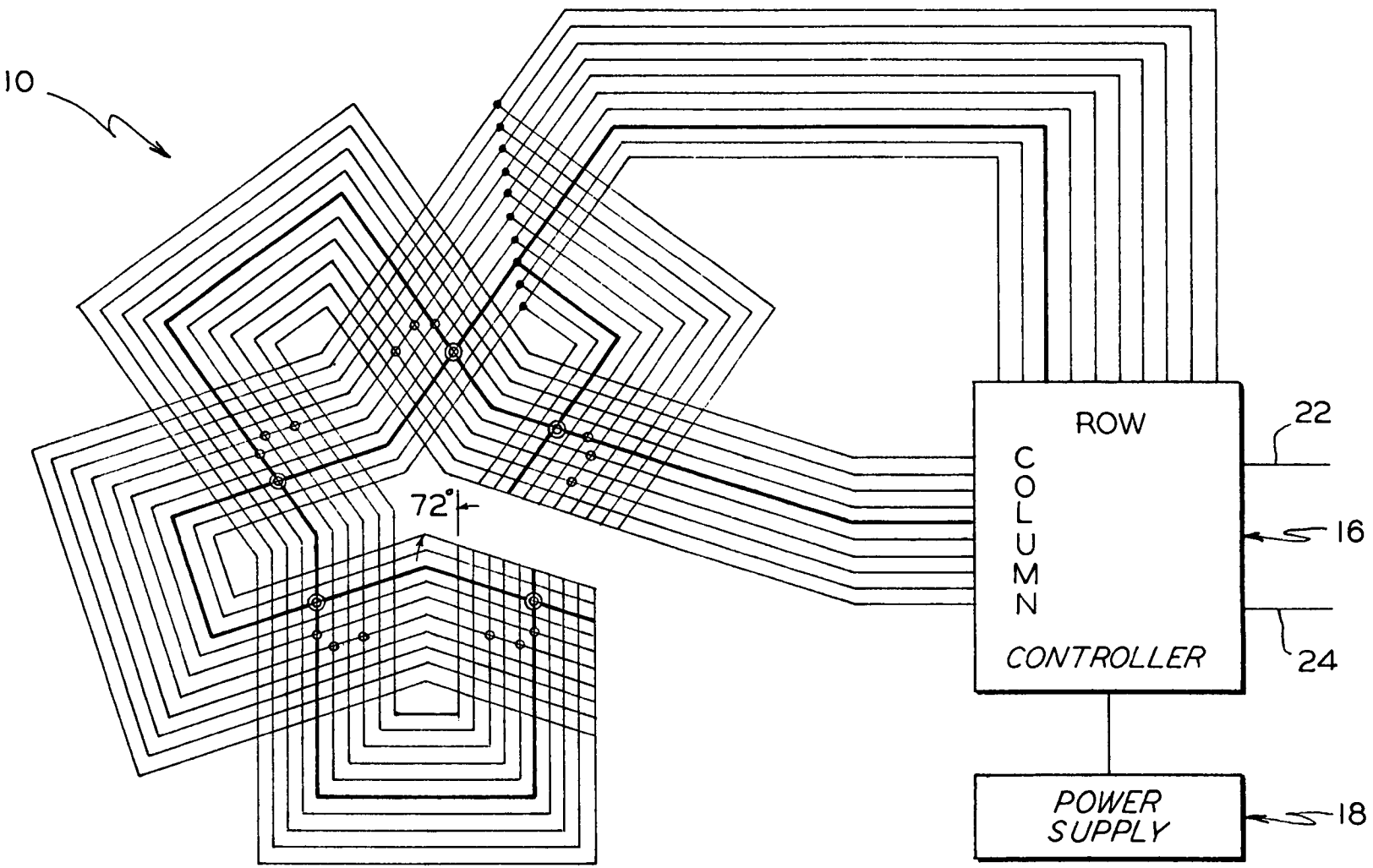
FIG. 4 is a schematic view of an illumination matrix with a substantially symmetrical arrangement showing a five-axis symmetry matrix having predetermined bulbs wired in parallel.
Figure 5:
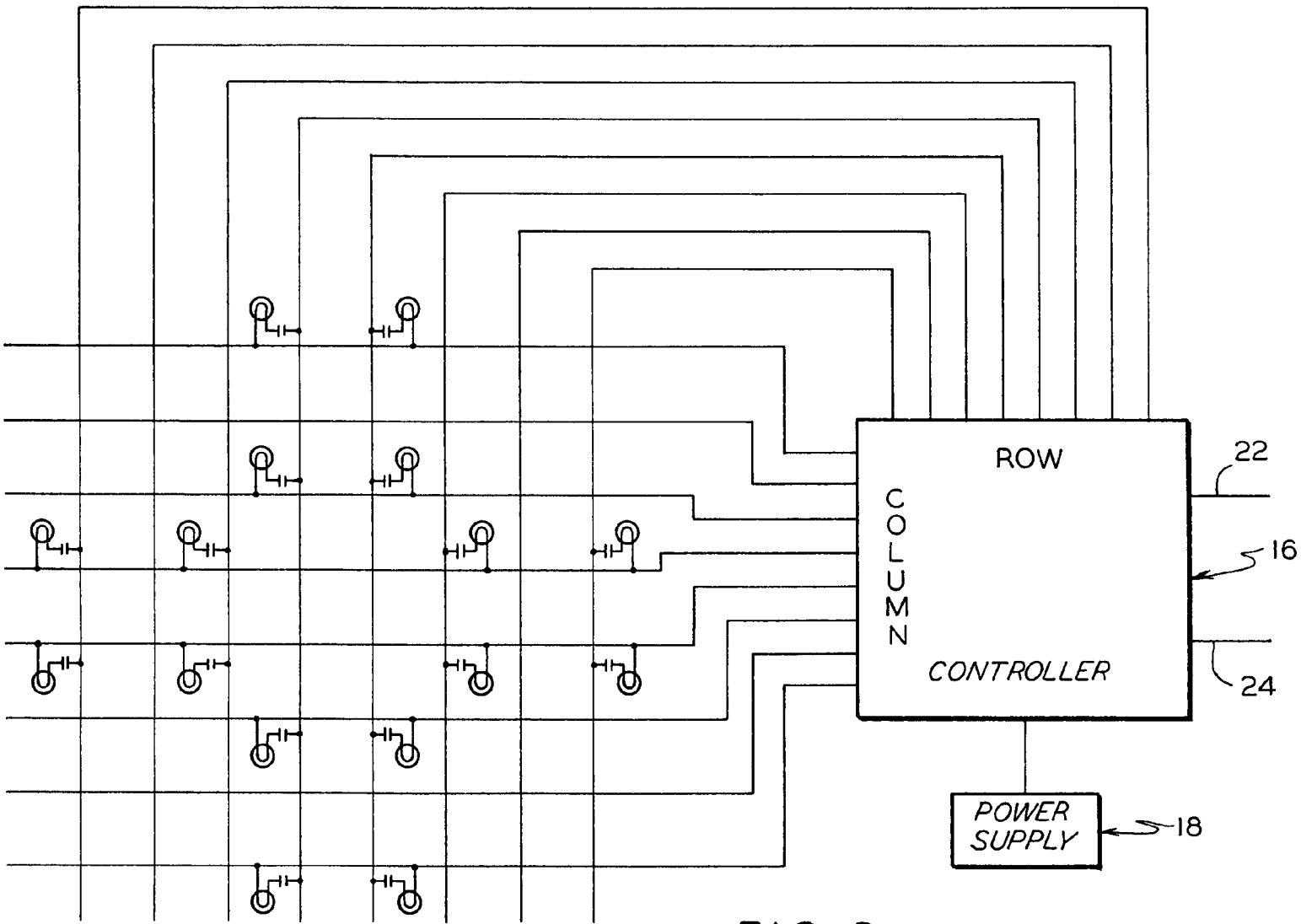
FIG. 5 is a schematic view of an illumination matrix with a substantially symmetrical arrangement showing a four-axis symmetry matrix.
Figure 6:
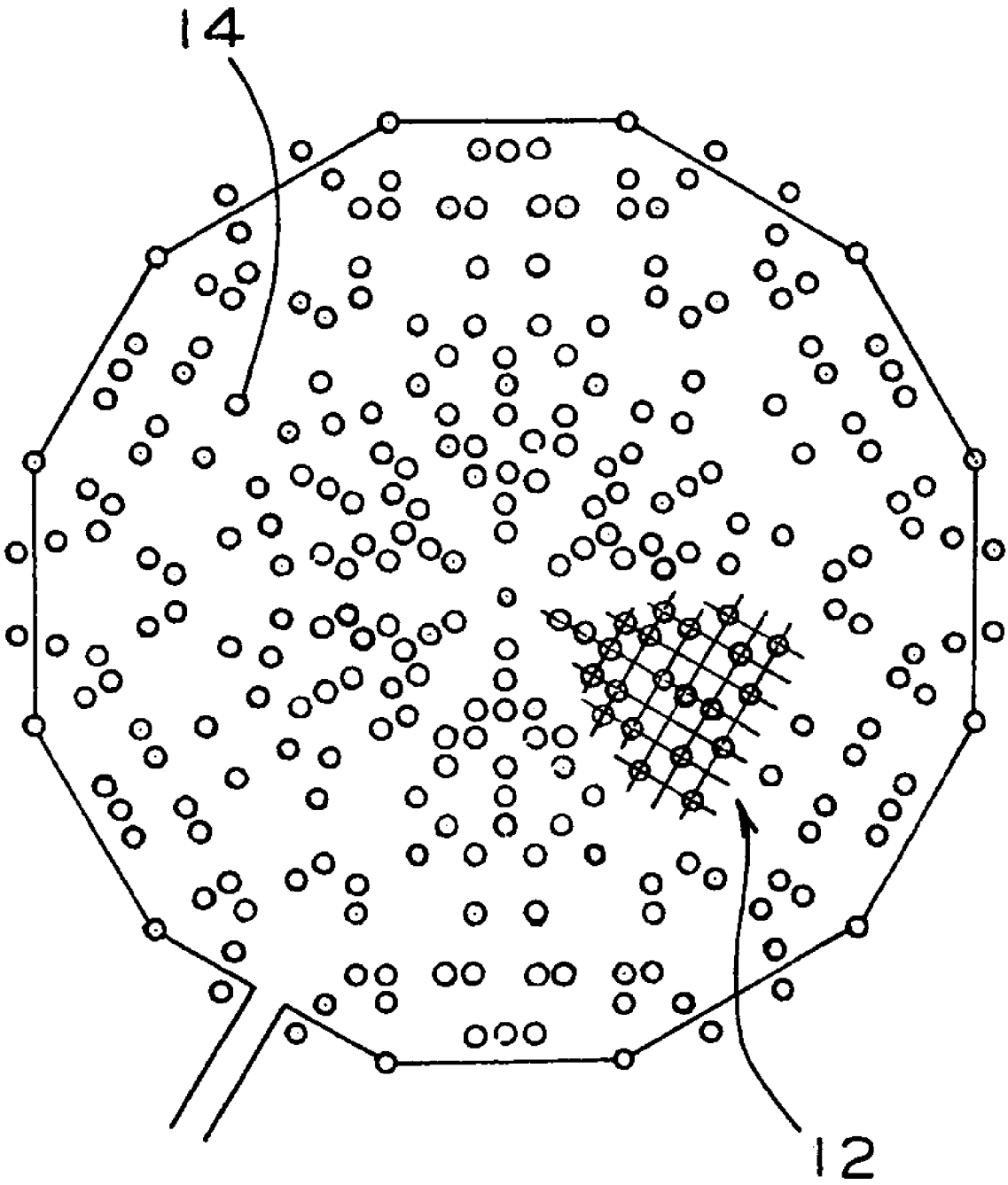
FIG. 6 is a schematic view of an illumination matrix with a substantially symmetrical arrangement showing the symmetry matrix wired in a hybrid configuration.
Figure 7:
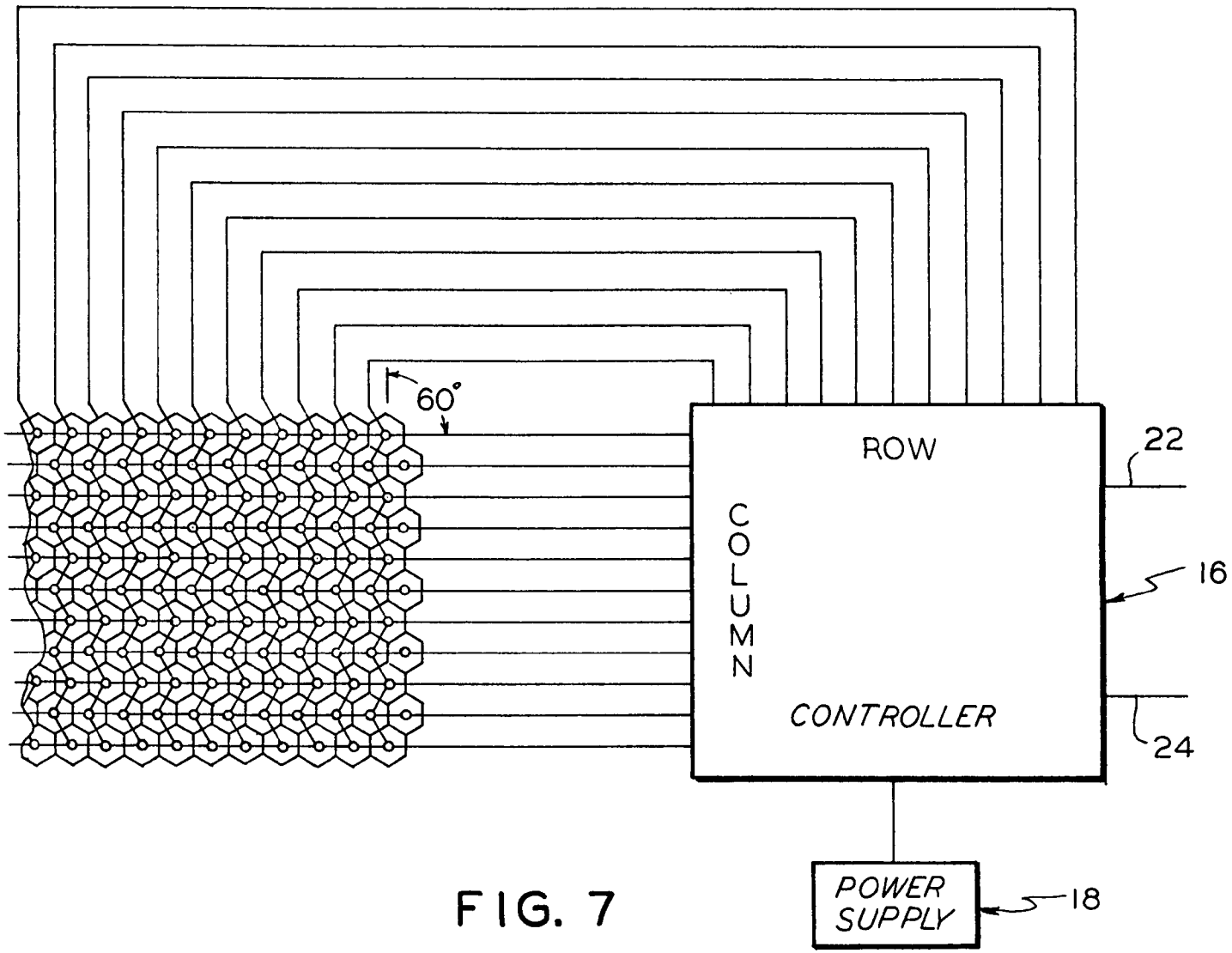
FIG. 7 is a schematic view of an illumination matrix with a substantially symmetrical arrangement showing an alternate embodiment of a six-axis symmetry matrix.
Figure 8:
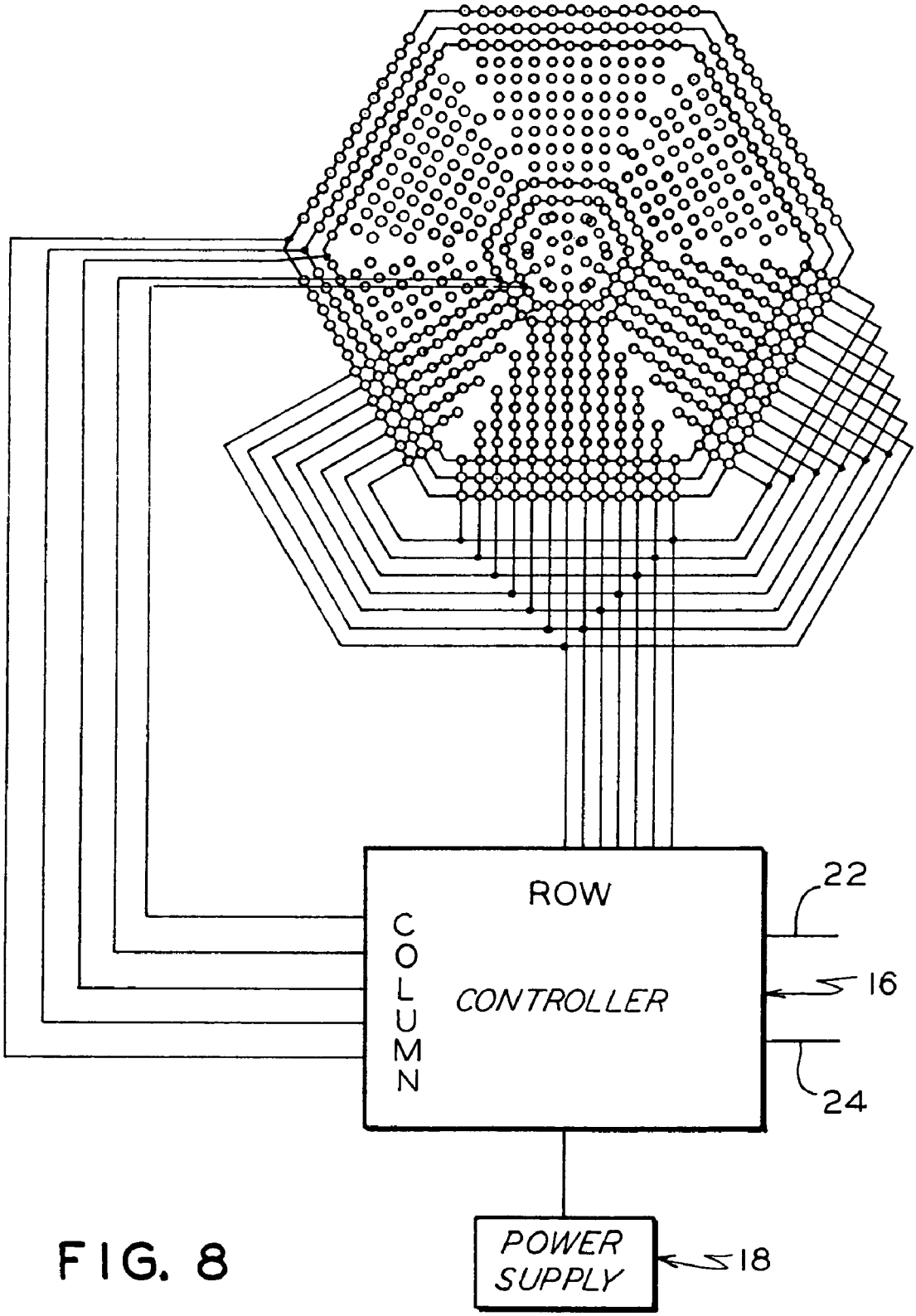
FIG. 8 is a schematic view of an illumination matrix with a substantially symmetrical arrangement showing a six-axis symmetry matrix having 90° matrix and 60° symmetry.
Figure 9:
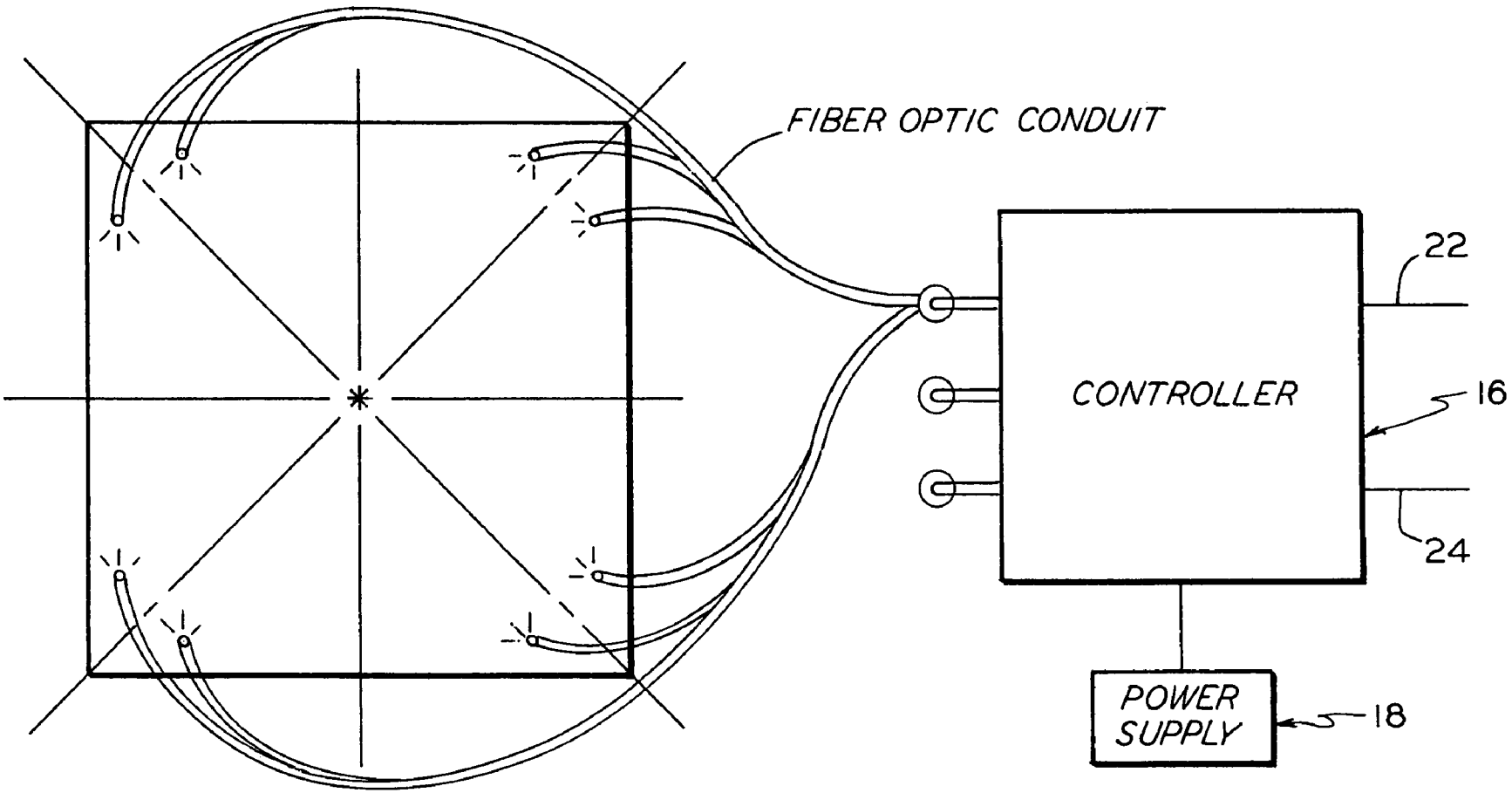
FIG. 9 is a schematic view of an illumination matrix with a substantially symmetrical arrangement that utilizes fiber optics.

The illumination devices 14 in the predetermined plurality of sets 12 are disposed in a substantially symmetrical matrix array having at least two substantially mirror axes, thereby producing an effect similar to reflected light without requiring use of mirrors. The illumination matrix with a substantially symmetrical arrangement 10 may have at least four substantially mirror axes. In a presently preferred embodiment, the illumination matrix with a substantially symmetrical arrangement 10 has at least six substantially mirror axes. The at least six substantially mirror axes are arranged in a substantially snowflake pattern as shown in FIG. 2.

The control means 16 is in communication with the predetermined plurality of sets 12 of illumination devices 14, each of such predetermined plurality of sets 12 of illumination devices 14 to be separately controlled thereby. The control means 16 is one of an analog and a digital circuit. The control means 16 is further capable of generating random data internally. The illumination matrix with a substantially symmetrical arrangement 10 may further include a means 22 connected to the control means 16 for receiving at least one of binary data, multi-discrete data, random data, complex-seemingly random data, partly random data, and pseudo-random data.

An energization means 18 is connected to the control means 16 for energizing the predetermined plurality of sets 12 of illumination devices 14 in a predetermined manner. In a presently preferred embodiment, the predetermined manner is a random manner. The energization means 18 may include a thermal timer, a resistor and a capacitor, or a digital device for timing the energizing of such sets 12 of illumination devices 14.

The illumination matrix with a substantially symmetrical arrangement 10 may further include a means 24 connected to the control means 16 for receiving an acoustic signal, and each of the predetermined plurality of sets 12 of illumination devices 14 is energized in accordance with predetermined characteristics of the acoustic signal. The acoustic signal is obtained by one of a direct connection to an audio system and a microphone (not shown) included in the illumination matrix with a substantially symmetrical arrangement 10. For example, the audio system can also play a pre-recorded song or music while simultaneously displaying a pre-recorded symmetrical light pattern such that the light pattern matches the music's tempo, frequency, content or beat. Each of the predetermined plurality of sets 12 of illumination devices 14 can also be energized in accordance with predetermined characteristics of the binary data, multi-discrete data, random data, complex-seemingly random data, partly random data, and pseudo-random data discussed above.

The illumination matrix with a substantially symmetrical arrangement 10 may include virtual-symmetry-sets (VSS), a set of illumination points that are all at the same relative location in their respective section of symmetry and all are at the same level of illumination at the same time.

Examples of random data that can be communicated to the control means 16 include: Binary or multi-discrete state inputs such as data representations of on/off status of building lights scattered around a wide area of the building, cpu data bus, cpu address bus, internet data such as binary IP address, IP port number being sent received, VSS indicating which computer is being 'pinged', activity of IP packets sent/received for which computer or IP address (the IP address's I/O activity being represented by a single VSS, other binary numbers, industrial binary data such as a set of valve statuses (open=green/intermediate=yellow/closed=red) data, home data such as which lights at home remain on, which doors or windows are open or unlocked, mailbox full/empty status, motion detector status for young children location/activity, answering machine status (new messages or not), washer status (done/not done or empty/not empty), dryer status, commercially available X10 commands/status display of appliances previously or currently commanded, hot water tank temperature status (above 110° or not), bathroom light status (indicating a bathroom's occupancy or 'availability' or not), stove status (all burners and oven off or not), garage door status (open/closed), gas flow status, water flow status, electrical current status, HVAC status AC/furnace/running/idle), hot tub status (off/on/up to temperature), phone line status (phone in use or not), outdoor rain/snow/wind/temperature status or internet data indicating predicted probability of precipitation (thus creating a status indicator to immediately advise if one should take their umbrella or not, and/or take their jacket or not), midi musical data such as which instrument is playing or which keyboard/piano key is pressed, or an attractive and useful 'casemod' for computer cases which attractively displays data such as binary representation of disk I/O access (head, cylinder and track the disk is accessing data from) and/or binary representation of data last received by a TCP/IP port, etc. Binary values for the date and time may also be displayed in the above manner.

Further, by combining red (on/off) & green (on/off) & blue (on/off) in each of the illumination devices 14 to yield a $2^3$ or 8 discrete states for one lamp, more information can be conveyed in the same space, yet in an attractive and redundant manner.

An additional means of generating a more pleasing display with higher information content is to cause the predetermined plurality of sets 12 of illumination devices 14, or individual illumination devices 14, to gradually fade after a status is no longer present. This gives a historical representation of the status of the represented input. Also, the intensity of the predetermined plurality of sets 12 of illumination devices 14 could represent a time average or accumulated value of the represented input. (For Example, the average time the A.C. fan has been on vs. off over the last 5 minutes or the number of 'ICMP pings' that have been received in the past hour). It can also indicate which music notes have recently been played.

An additional modification to the illumination matrix with a substantially symmetrical arrangement 10 is to provide an 'intensity ASDR' (attack, sustain, decay, release) whereby a digital input to the control means 16 causes the illumination of an illumination device 14 to rise at a linear or curved rate, reach a limit value which is sustained as long as the input is on, or for a fixed minimum duration, decay at a linear or curved rate and release when the illumination reaches a minimum threshold.

The ability of each of the illumination devices 14 to produce both multi-color and multi-intensity levels can convey more information and generate all possible combinations of hues and intensities.

The illumination matrix with a substantially symmetrical arrangement 10 can also be configured to display status data to an observer. If one set of illumination devices 14 is blocked, the observer can still see the other redundant sets of illumination devices 14 to determine the status.

The illumination matrix with a substantially symmetrical arrangement 10 can further help the mind to understand or discern the processes' inputs behind the pattern by simultaneously displaying multiple binary statuses in a small area thus allowing the mind's inductive powers to observe which input devices tend to correlate with each other simultaneously or through a time sequence pattern.

Analog inputs to the control means 16 can be interpreted and displayed in a variety of manners. For example, a sound frequency range could light a specific set of illumination devices 14. Many sound frequency ranges input to the control means 16 in a single audio input could thus control many sets of illumination devices 14 simultaneously. Thus a song, music, symphony, specific instrument in a band, environmental sounds, speech, or noise can be attractively and/or meaningfully displayed. The intensity of the frequency being input could generate a corresponding analog brightness value to the set of illumination devices 14. Other combinations of inputs can be joined in meaningful fashion such as the frequency range and amplitude of a specific instrument. For example, a piano lights the red portion of the set of illumination devices 14, while the frequency range and amplitude of the trumpet lights the green portion of the same set of illumination devices 14 yielding colors from black to bright red to bright green to bright yellow for the same set of illumination devices 14 depending on the sounds produced by the piano and trumpet at that time. Research may find that the visual pattern generated by an audio speech input may assist in sound or speech recognition of what was spoken in hearing impaired individuals. Alternately, the device may be able to inexpensively convey to the hearing impaired the characteristic nature of sounds in their environment, allowing them to learn and then discern the appearance of a telephone ringing vs. a fire alarm vs. a doorbell vs. thunder vs. a child crying vs. an automobile horn vs. the microwave 'beeping' when finished vs. someone shouting vs. someone knocking on the door vs. the dryer signaling when done vs. a toilet flushing vs. a door slamming vs. an ambulance or police siren. The illumination matrix with a substantially symmetrical arrangement 10 could be semi-permanently wall mounted in their home, or small and mobile to be used anywhere for this purpose. It is recommended that a logarithmic sound to illumination intensity be used in this application to enable capture of low volume and high volume sounds as the ear does, and a logarithmic frequency band and frequency band separation be used.

The illumination matrix with a substantially symmetrical arrangement 10 can be configured to simply display the signal strength of multiple audio inputs simultaneously and attractively by each of the predetermined plurality of sets 12 of illumination devices 14 in a grayscale or degree of illumination being determined by the audio signal strength for that input.

Other applications may combine random data and/or analog and digital inputs to attractively display meaningful values. One example is an automotive display that displays the analog values representation of engine temperature, vacuum pressure value, choke position value, throttle position, RPM, current MPH, spark plug firing events, gear number engaged, clutch position, brake position, emergency brake position, acceleration rate, deceleration rate, battery amps charge/discharge, oil pressure, odometer reading, etc. Many of these inputs may come from the engine diagnostic port. This may be displayed externally on an area of the auto's surface during auto races or for parade floats.

The present invention is capable of displaying a constantly changing binary representation of the date and/or time where the year, month, day, hour, minute, second are represented as binary numbers, such as a binary coded decimal (BCD). For example, the innermost four bulbs could be lit according to the last digit of the year (ex. 2004=4=0100 or off, on, off, off). The next four bulbs going outward could be the month (ex. Nov=11=1011 or on, off, on, on). The next five could be the day of the month (ex. $28^{th}$=11100). The next five could be the hour of the day in military time (ex. 7 pm, or hour 19 would be 10011, and so on down to the second, half second, or quarter second level). This could be further 'covered' by analog clock hands to allow anyone to read it but present an ever-changing symmetrical background display that would only repeat every ten years (or every hundred years if the 10's digit of the year is incorporated). Alternately, the binary representation of the number of seconds past Jan. 1, 2000, January 1 of the current year, or ones date of birth may also be represented, albeit less readably.

Another feature of this invention is its capability to generate snowflake shapes only. One method is to pre-store pleasing snowflake shapes in a memory storage device such as an Eprom. The pre-stored shapes need not be stored as a complete flake, but due to the inherent symmetry of the snowflake and the shapes generated by the device only one 'arm' or segment need be stored, and the remainder segments can be generated by algorithms or look up tables which map the remaining symmetrical locations in the remaining 'arms'. Further, the snowflake displayed can be randomly invoked or invoked by the digital or analog values input. For example, a set of binary inputs '10010100' will evoke pattern number 148. Alternately, it may evoke a sequence of patterns 148, 149, and so on, changing periodically or sporadically until a new binary input is present.

Another manner to generate snowflake patterns based on inputs is to use a software algorithm to connect any otherwise isolated points to the nearest 'branches' by finding a near minimized branch path to illuminate all lamps in between. A manner to generate snowflake patterns which gradually change can be done by periodically or sporadically going into 'subtraction mode' or 'inverted mode' where the new lamps locations which normally would light unlit lamps instead turn off lit lamps or use an XOR function.

A three-dimensional version of this device can be created in space as a new form of 'chandelier', with the illumination devices 14 being located at the intersection of sets of grids of rows and columns of wires hanging from the ceiling for example.

One advantage of this symmetrical matrix of lights is that if less expensive bulbs prone to burnout are used, or overdriven LEDS also prone to burnout are used, the burnout of one light emitting element in the VSS can be detected and all other light emitting elements in the VSS can be designated to be unlit from then on, but the symmetry and overall aesthetic effect can be maintained. Thus the overall expense of higher-grade light emitting elements can be avoided for the same degree of illumination. Or simply stated another way, the device can be manufactured more inexpensively because it need not rely on all light emitting elements remaining lit through its designed product lifetime.

Another advantage of this symmetrical arrangement of lights is that the illumination elements need only sparsely fill some areas of the device, especially the outer areas. This means that less light emitting elements can be used in the device overall, yet it maintains its aesthetic qualities and appears to occupy the same amount of area. Actually, the pattern of omitted light emitting elements can be made to be unique in each unit sold, making each display unique as purchased further reducing the probability of seeing the same pattern twice. Further, a more sparsely filled array is actually more pleasing because it avoids the appearance of having large 'clumps' of lights on. Thus the esthetic-creation-potential/number-of-light-emitting-elements is seen to be a higher ratio or value to the purchaser than an off-the-shelf array of elements completely filling the display area.

It should be noted that a further enhancement to appearance could be achieved by having groups of smaller symmetries symmetrically distributed at the periphery of the device. The appearance of a 'changing digital oriental rug' can thus be achieved.

The present invention can be used as a teaching tool in geometry to teach symmetry, or as a teaching tool in mathematics to teach probability, binary numbers, or statistics.

It can also be envisioned to offer medical data such as patient pulse, respiration, EKG/EEG data, or be used for biofeedback purposes.

Further, it can also be envisioned to be used in computer security applications such as enabling a computer to simply and quickly generate randomly or semi-randomly patterned icons to be chosen from among other similar icons on a computer desktop by one who knows which areas or characteristics in the icons to look for or look at. Another area of security application would be a 'user challenge-response' display where the data or icon would be 'hidden' by many other icons of a similar nature and only a trained user will know which one to choose or how to respond (which one to click, which button to push, etc.). The attractive binary pattern can be placed in a document (example, at beginning and/or end), as a checksum mathematically derived from the content of the document (or picture—example, on the back), using a secret algorithm. This can then be scanned and reverse checked to verify the wording or picture has not been changed. It may also be used as a redundant two-dimensional binary code on a label which can be scanned in to indicate routing of a package, the advantage being that the symmetry pattern makes it more 'human recognizable', and if areas of the pattern are destroyed, the redundancy allows the data contained to still be correctly read. Labels of this configuration placed on doors, light switches, luggage or boxes can be used to attractively allow valid users to recognize their contents without others knowing what is inside. This is easier to recognize for some (especially from a distance) than a string of numbers and/or characters or can be combined with the number strings as an additional memory aid or visual aid.

An additional security application would be to use it as a security display to display a prompting discernable symmetrical pattern hidden in the larger symmetrical display of random or pseudo-random data. The discerned prompt pattern hidden in the display communicates with the user and causes the user to respond with a specific action within a specific interval of time indicating the user is a valid user wishing to perform an action such as logging on to a computer, unlocking a lock, or opening a door. For example, the valid user may be pre-instructed to know that the symmetrical area halfway outwards from the center and midway between the symmetrical axes needs to display a pattern of an O-shape using its illumination devices. The present invention displays random data everywhere (excepting that data at that location) for a random time interval until it briefly displays that pattern and then continues to display random data. When that occurs the user has half a second to push the pushbutton to allow entry into a door. Alternately, the user may be pre-instructed to push the letter k on a keyboard when that pattern is displayed within the random symmetrical data displayed on the screen. In this manner, an observer cannot discern how to gain access, unlike a fully discernable and observable typed computer password. Also, it is not evident where the user's eyes are focused on the display since they can look at any symmetrical segment or given a suitable display, focus on the center. The eye's 'blind spot' is not a problem. Observable indicators may be more than just patterns but colored patterns, changes to patterns, changes in colors, multiple pattern areas which must be displayed simultaneously or in a specific sequence, etc. For further security, this may be extended to a 'challenge-response' dialog between the display and the user. In a public area prone to vandalism, if a section of the screen is damaged, the other redundant symmetrical sections not vandalized can still be successfully observed.

If the density profile of possible light emitting elements is shaped like a star, the device will tend to display star shaped patterns (ex. six-axis symmetry yields a six-sided star) whereas if the density profile of possible light emitting elements is shaped like a hexagon, the device will tend to display snowflake shaped patterns.

The overall matrix may be distorted to fit on the surface of a hemisphere or a partial area of the surface of a hemisphere and still display its visually symmetrical pattern. A five-axis symmetry may repeatedly display in every facet of a flat-faced or curved faced dodecahedron.

It is important to note that commercially available LED matrixes are at 90° angles suitable for four-axis symmetry and not well suited for a geometrically accurate or esthetically smooth and pleasant five-axis (72°), six-axis (60°), seven-axis (51.43°), etc. symmetries.

An alternative to light emitting elements is the use of a LCD panel to symmetrically block light passing through it, creating the same visual effect. Alternately, fiber optic or light guides can be used to symmetrically illuminate all or some of the light to its remaining points in the VSS.

The present invention can be used in a security application to indicate information that the security personnel can meaningfully interpret but the general public should not know. For example, each VSS can indicate a section of the store where a suspected shoplifter may be active, which emergency exits are open, which sections are currently being monitored by closed circuit TV, or in a 'gaming industry' application which tables have suspected 'card cheaters'.

It should be noted that it might be found to be esthetically optimal to exhibit simpler patterns, a slower change in patterns or no patterns for a period of time to 'give the brain a rest'. Exhibiting no patterns or simpler patterns with fewer light emitting elements being on also serves to increase the useful product lifetime of the device.

A means of encoding a binary number is to assign the lowest bits to the lamps in the center, and as the display's number of lamps increases, the binary value of the lamps increases. The innermost would be 0 or 1, the next one radially more distant from the center and closest to the axis line would have a value of 0 or 2 depending on its unlit/lit status, the one next to it would have a value of 0 or 4, etc.

While the present invention has been described by way of a detailed description of variously preferred embodiments, it will be readily apparent to those of ordinary skill in the art that various substitutions of equivalents may be affected without departing from the spirit or scope of the inventions set forth in the appended claims.

I claim:

1. An illumination matrix having a symmetrical arrangement, said illumination matrix having said symmetrical arrangement comprising:

(a) a support member;

(b) a predetermined plurality of sets of illumination devices disposed one of on, in, and a combination of on and in said support member, each set of said predetermined plurality of sets of said illumination devices includes a predetermined number of illumination devices, said illumination devices in said sets being disposed in a substantially symmetrical matrix array having at least two substantially mirror axes, thereby producing an effect similar to reflected light without requiring use of mirrors;

(c) a control means connected to said sets of illumination devices for controlling various outputs thereof, each of said sets of illumination devices to be separately controlled thereby automatically; and (d) an energization means connected to said control means for energizing said sets of illumination devices only in a symmetrical manner in response to at least one of an external, an internal, a random and a semi-random stimuli.

2. An illumination matrix having a symmetrical arrangement, according to claim 1, wherein said symmetrical manner is a random manner.

3. An illumination matrix having a symmetrical arrangement, according to claim 1, wherein said illumination matrix has at least four substantially mirror axes.

4. An illumination matrix having a symmetrical arrangement, according to claim 1, wherein said illumination matrix has at least six substantially mirror axes.

5. An illumination matrix having a symmetrical arrangement, according to claim 1, wherein said illumination matrix is arranged substantially in a snowflake pattern.

6. An illumination matrix having a symmetrical arrangement, according to claim 1, wherein said control means is one of an analog and a digital circuit.

7. An illumination matrix having a symmetrical arrangement, according to claim 1, wherein said illumination devices have a predetermined address.

8. An illumination matrix having a symmetrical arrangement, according to claim 7, wherein said predetermined address is determined by a row and a column location.

9. An illumination matrix having a symmetrical arrangement, according to claim 7, wherein said illumination devices has at least four substantially mirror axes.

10. An illumination matrix having a symmetrical arrangement, according to claim 7, wherein said illumination devices has at least six substantially mirror axes.

11. An illumination matrix having a symmetrical arrangement, according to claim 10, wherein each of said illumination devices is capable of illuminating .in multiple colors.

12. An illumination matrix having a symmetrical arrangement, according to claim 11, wherein said illumination devices further display one of said multiple colors according to a signal received from said control means.

13. An illumination matrix having a symmetrical arrangement, according to claim 11, wherein each of said illumination devices is one of a lamp and a light emitting diode (LED).

14. An illumination matrix having a symmetrical arrangement, according to claim 11, wherein said illumination matrix further includes a means connected to said control means for receiving at least one of binary data, multi-discrete data, random data, complex-seemingly random data, partly random data, and pseudo-random data.

15. An illumination matrix having a symmetrical arrangement, according to claim 14, wherein each of said sets of illumination devices is energized in accordance with predetermined characteristics of said binary data, said multi-discrete data, said random data, said complex-seemingly random data, said partly random data, and said pseudo-random data.

16. An illumination matrix having a symmetrical arrangement, according to claim 1, wherein said energization means includes a thermal timer for timing said energizing of said sets of illumination devices.

17. An illumination matrix having a symmetrical arrangement, according to claim 1, wherein said energization means includes a resistor and a capacitor for timing said energizing of said sets of illumination devices.

18. An illumination matrix having a symmetrical arrangement, according to claim 1, wherein each of said illumination devices illuminate at various intensities according to a signal received from said control means.

19. An illumination matrix having a symmetrical arrangement, according to claim 1, wherein said illumination matrix further includes a means connected to said control means for receiving an acoustic signal.

20. An illumination matrix having a symmetrical arrangement, according to claim 19, wherein each of said sets of illumination devices is energized in accordance with predetermined characteristics of said acoustic signal.

21. An illumination matrix having a symmetrical arrangement, according to claim 19, wherein said acoustic signal is obtained by a direct connection to an audio system.

22. An illumination matrix having a symmetrical arrangement, according to claim 19, wherein said acoustic signal is obtained from a microphone included in said illumination matrix.

23. An illumination matrix having a symmetrical arrangement, according to claim 1, wherein said control means is capable of generating random data internally.

24. An illumination matrix having a symmetrical arrangement, according to claim 1, wherein said illumination devices are arranged in a three-dimensional pattern.

* * * * *